US007367321B2

(12) United States Patent
Ichikatai

(10) Patent No.: US 7,367,321 B2
(45) Date of Patent: May 6, 2008

(54) ERRONEOUS CONNECTION DETECTING METHOD OF IGNITION DEVICES AND APPARATUS OF THE SAME

(75) Inventor: Yukio Ichikatai, Atsugi (JP)

(73) Assignee: Nikki Co., Ltd., Kanagawa-Ken (JP)

( * ) Notice: Subject to any disclaimer, the term of this patent is extended or adjusted under 35 U.S.C. 154(b) by 0 days.

(21) Appl. No.: 11/580,114

(22) Filed: Oct. 13, 2006

(65) Prior Publication Data

US 2007/0283926 A1 Dec. 13, 2007

(30) Foreign Application Priority Data

Jun. 13, 2006 (JP) ..... 2006-162999

(51) Int. Cl.
*F02D 41/36* (2006.01)
*F02D 45/00* (2006.01)

(52) U.S. Cl. ..... 123/475; 73/116; 73/119 A; 123/198 D; 123/479; 123/630; 324/503

(58) Field of Classification Search ..... 123/198 D, 123/475, 479, 630; 73/116, 117.2, 117.3, 73/119 A; 324/391, 503; 701/105
See application file for complete search history.

(56) References Cited

U.S. PATENT DOCUMENTS 4,543,936 A * 10/1985 Gardner et al. ..... 123/475
4,932,381 A * 6/1990 Rousseau et al. ..... 123/479
5,107,701 A * 4/1992 Smith ..... 73/119 A
5,325,835 A * 7/1994 Kimata et al. ..... 123/475
6,079,259 A * 6/2000 Starman ..... 73/118.1
6,761,059 B2 * 7/2004 Hsia et al. ..... 73/119 A

* cited by examiner

*Primary Examiner*—T. M Argenbright
(74) *Attorney, Agent, or Firm*—Rader, Fishman & Grauer PLLC

(57) ABSTRACT

A method and an apparatus detect an erroneous connection between a plurality of ignition devices and a fuel injection control device. A first time interval is measured from an input of an ignition signal for a certain cylinder to an input of the next ignition signal and a second time interval from an input of the next ignition signal to an input of a further next ignition signal. An erroneous connection is determined by comparing a relationship between the first time interval and the second time interval with a previously stored normal relationship between the first time interval and the second time interval that are correctly connected in accordance with a predetermined procedure. The erroneous connection is outputted and displayed to a predetermined erroneous connection display device if it is determined that the erroneous connection exists.

4 Claims, 4 Drawing Sheets

ERRONEOUS CONNECTION DETECTING METHOD OF IGNITION DEVICES AND APPARATUS OF THE SAME

BACKGROUND OF THE INVENTION

1. Field of the Invention

The present invention relates to a method of detecting an erroneous connection in the case of erroneously connecting lines of ignition devices arranged in respective cylinders in an engine having a plurality of cylinders, and an apparatus of the same, and more particularly to a method for detecting an erroneous connection in the case of erroneously connecting a line for transmitting an ignition signal from an ignition device for a predetermined cylinder, in place of another line for another cylinder, in a fuel injection control apparatus of an engine utilizing ignition signals of ignition devices as reference timings of fuel injection timings, and an apparatus for executing the method.

2. Description of Related Art

Conventionally, in a fuel injection system of a general-purpose engine having a comparatively compact and simple structure, data for comprehending the operating state of the engine such as a crank angle position, an engine speed or the like, is generally is used for each of controls by detecting ignition signals of magnet type ignition devices by a fuel injection control apparatus, without using any special crank angle sensor.

For example, the fuel injection control for each cylinder in the engine has a fuel injection control apparatus which detects a primary side voltage signal of an ignition device, generates a valve opening signal using this signal as a reference timing so as to output it to an injector of each cylinder, and executes the fuel injection control, as described in Japanese Unexamined Patent Publication No. 6-10746.

In the control apparatus mentioned above, in the case of an engine having a plurality of cylinders in which interval between respectively successive ignition timings for the cylinders are different, ignition devices 2 and 3 are respectively necessary for the cylinders having the different injection timings, such as in a fuel injection system shown in FIG. 5, and the ignition devices 2 and 3 are connected to an electronic control unit 100 by lines 22 and 32, respectively. In this case, in the control system mentioned above, there may be generated an erroneous connection, for example, that the line 22 from the ignition device 2 for an ignition plug 81 provided in a certain cylinder 41 corresponding to a first cylinder, and the line 32 from the ignition device 3 for an ignition plug 82 provided in a cylinder 42 corresponding to a second cylinder are inversely connected to input terminals provided in the electronic control unit 100.

In this case, the ignition of the first cylinder is executed when the injection of the second cylinder is carried out by the electronic control unit 100, and the ignition of the second cylinder is executed when the injection of the first cylinder is carried out. Accordingly, there is a problem that a malfunction of the engine operation is caused, and an emission defect is caused. However, in the fuel injection system of the general-purpose engine in which an inexpensiveness is required by a simple structure, a cylinder discriminating means such as a crank angle sensor or the like is not arranged generally, and the system is not provided with a function of detecting the erroneous connection or correcting the timing of the fuel injection, so that it is impossible to avoid the emission defect and it is not easy to specify its cause.

SUMMARY OF THE INVENTION

The present invention is made for the purpose of solving the problem mentioned above, and an object of the present invention is to make it possible to securely detect an erroneous connection between ignition devices and a fuel injection control apparatus by a simple structure without causing any cost increase, in a fuel injection control apparatus of a multiple cylinder engine utilizing ignition signals of ignition devices as reference timings of fuel injection timings.

In accordance with the present invention, there is provided a method of detecting an erroneous connection between a plurality of ignition devices and a fuel injection control apparatus, the method being executed by the fuel injection control apparatus of a type which is provided in a multiple cylinder engine having different interval times between successive ignition timings for cylinders, and outputs fuel injection signals to injectors of the respective cylinders by receiving ignition signals, via respective lines, from the ignition devices outputting ignition signals to predetermined cylinders and utilizing the ignition signals as reference timings for fuel injection timings. The method comprises the steps of:

measuring a first interval time from an input of an ignition signal for a certain cylinder to an input of the next ignition signal, and a second interval time from an input of the next ignition signal to an input of a further next ignition signal input; determining whether or not an erroneous connection exists, by comparing a relation between the first interval time and the second interval time with a previously stored normal relation between the first interval time and the second interval time in the case that the lines are correctly connected in accordance with a predetermined procedure; and outputting and displaying the erroneous connection to a predetermined erroneous connection display means if it is determined that the erroneous connection exists.

As mentioned above, since the existence of the erroneous connection is judged by continuously measuring two ignition signal interval times of the ignition signals successively input from the ignition devices of the respective cylinders and comparing the relation between the interval times with the correct relations between the interval times, it is possible to automatically detect the erroneous connection from the ignition devices by a simple structure and at a low cost without any cylinder discriminating means such as the crank angle sensor or the like, and it is possible to securely recognize the generation of the erroneous connection.

Further, if the procedure of the comparison is executed by comparing magnitude relations between the first interval time and the second interval time or numerical values indicating a ratio between the first interval time and the second interval time, and the erroneous connection is determined if two magnitude relations or two numerical values do not coincide with each other, it is possible to securely judge on the basis of a simple procedure without applying an excessive process load to the fuel injection control apparatus.

Further, in accordance with a fuel injection control apparatus of a multiple cylinder engine executing the erroneous connection detecting method mentioned above, comprising a plurality of input interfaces for connecting lines from ignition devices so as to input ignition signals, a timer means, an interval time measuring means, an interval time comparing means, and output means outputting to the erroneous connection display means, wherein a normal relation of interval times in the same engine strokes as measured ignition signal intervals is stored in advance in a memory means, two interval times between the ignition signals are measured and stored by the interval time measuring means utilizing the timer means, a relation between two measured interval times and the normal relation between the interval times are compared by the interval time comparing means, and an erroneous connection is output to the erroneous connection display means by the output means in the case that the erroneous connection is determined, it is possible to achieve the erroneous connection detecting method mentioned above only by adding the fuel injection control apparatus to the fuel supply system of the engine.

In accordance with the present invention, it is possible to easily and securely detect the erroneous connection between the ignition device and the fuel injection apparatus by the simple structure without causing any cost increase.

DESCRIPTION OF PREFERRED EMBODIMENTS

Figure 1:
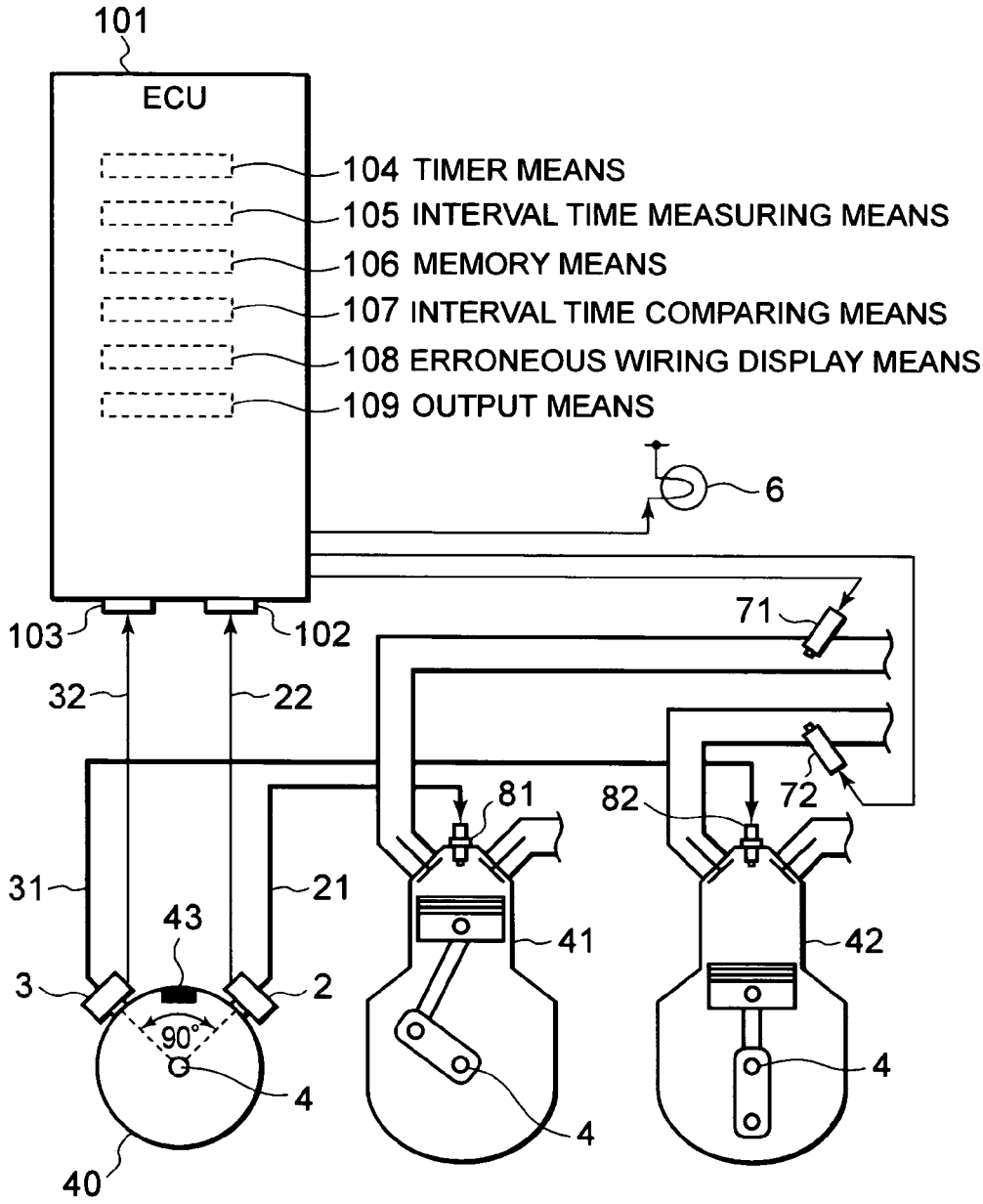
FIG. 1 is a view showing the arrangement of a fuel injection system of an engine in accordance with an embodiment of the present invention.

The description will be given below of a best mode for carrying out the present invention with reference to the accompanying drawings. In this case, in the present embodiment, the description is given of a case that the present invention is applied to a two-cylinder general-purpose engine, and further, in the drawings, a flywheel 40, a first cylinder 41 and a second cylinder 42 are shown in parallel as a matter of convenience for explanation, however, these elements are arranged in series on the same crank shaft 4 extending in a direction perpendicular to the drawings.

Figure 5:
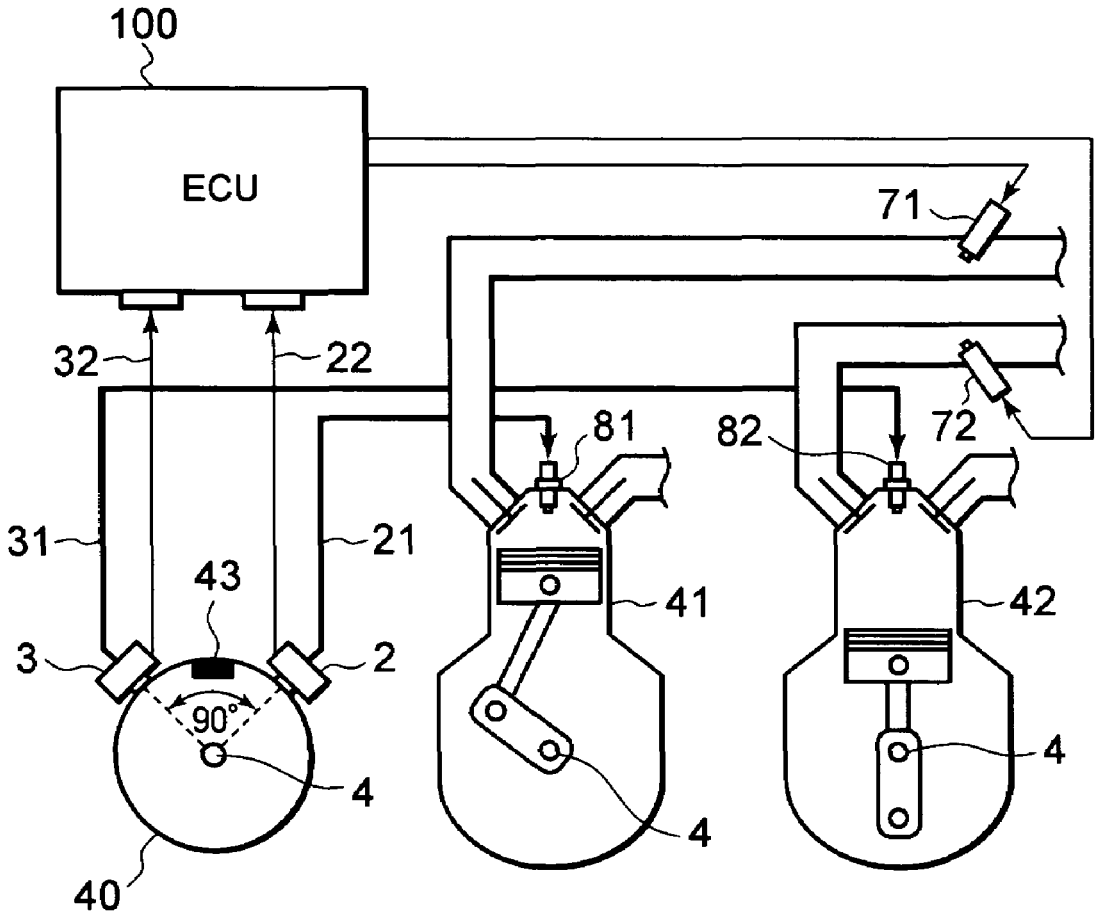
FIG. 5 is an arrangement view of a fuel injection control system of an engine in accordance with a prior art.

FIG. 1 shows an arrangement view of a fuel injection system of an engine in accordance with the present embodiment. A hardware structure of the system is approximately the same as the system shown in FIG. 5 mentioned above, however, a feature exists in a point that the electronic control unit 101 executes an erroneous connection detecting method mentioned below, and turns on a failure lamp 6 arranged in a driver seat or the like at a time of detecting the erroneous connection.

Ignition signals respectively generated from ignition devices 2 for a first cylinder 41 arranged close to a flywheel 40 and an ignition device 3 for a second cylinder 42 are input to interfaces 102 and 103 for the respective ignition devices provided in the electronic control unit 101 via a line 22 and a line 32.

The ignition devices 2 and 3 detect passage of a magnet 43 fixed to the flywheel 40 rotated on the basis of driving of the engine by a pickup coil, output the ignition signals from the secondary coils at ignition timings corresponding to crank angle positions, and make ignition plugs 81 and 82 generate sparks via lines 21 and 31.

In other words, power transistors are turned on by a voltage induced at times when the magnet fixed at the predetermined crank angle position of the flywheel 40 passes near the pickup coils of the ignition devices 2 and 3, and electric current flows through primary coils, the power transistors are turned off at moments when the magnet 43 passes over the pickup coils and the electric current is shut off, whereby a back electromotive voltage is generated in the primary coil side.

The electronic control unit 101 detects the primary side voltage signals as rotation signals of the engine, utilizes as reference timings for fuel injection timings on the basis of this, and outputs fuel injection signals to injectors 71 and 72 of the respective cylinders at correct injection timings. In this case, the electronic control unit 101 is structured such that a program for executing each of procedures of an erroneous connection detecting method mentioned below is stored in a memory portion of the electronic control unit for controlling the fuel injection directed to the general-purpose engine utilizing the ignition signals as the reference timings for the fuel injection timings, and each of the means mentioned below can be achieved functionally by this program. Further, the electronic control unit 101 is provided with a timer function by a timer means 104.

Figure 3:
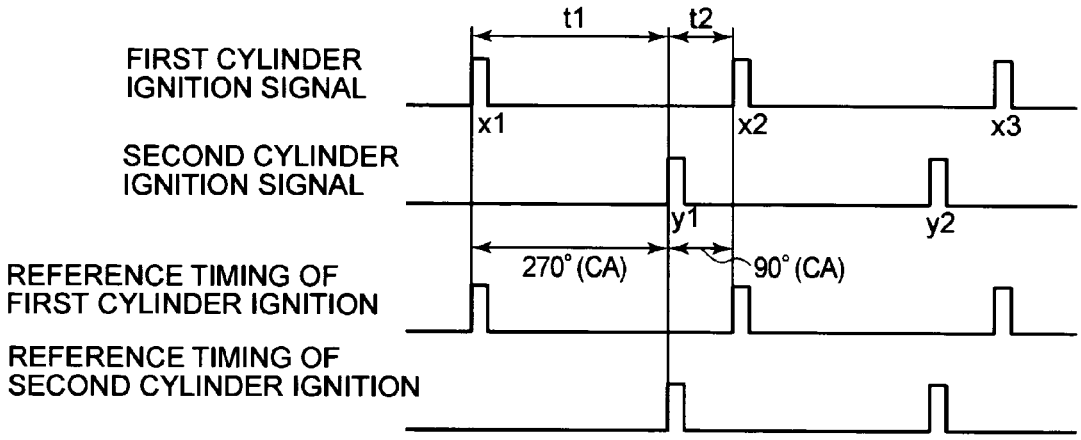
FIG. 3 is a graph showing each of ignition signals detected by an electronic control unit in FIG. 1 in the case that an erroneous connection does not exists, and injection signals output in correspondence thereto in time series.

The ignition device 2 for the first cylinder 41 and the ignition device 3 for the second cylinder 42 are provided at an interval of a crank angle of 90 degrees as shown in FIG. 1, and a crank angle interval (CA) from an ignition signal x1 for the first cylinder 41 to an ignition signal y1 for the second cylinder 42 comes to 270 degrees, and a crank angle interval (CA) from the ignition signal y1 to an ignition signal x2 for the next first cylinder 41 comes to 90 degrees, as shown in a waveform view of the ignition signals and the injection timings shown in FIG. 3. Further, the injection timing of the injector 71 for the first cylinder 41 and the injection timing of the injector 72 for the second cylinder 42 are respectively set to inject in synchronization with an ignition signals xn and an ignition signal yn.

In this case, in the case that the lines 22 and 32 for the ignition signals have no erroneous connection and are connected normally, a relation $t1>t2$ is obtained by comparing a time t1 from the ignition signal x1 to the ignition signal y1 with a time t2 from the ignition signal y1 to the ignition signal x2 as shown by the waveform view in FIG. 3 when the engine is rotated approximately at a fixed speed.

Figure 4:
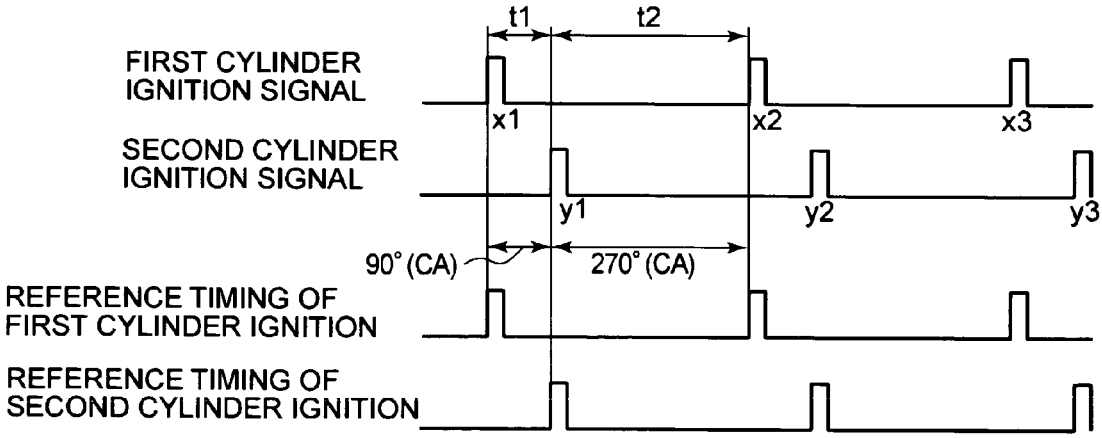
FIG. 4 is a graph showing each of the ignition signals detected by the electronic control unit in FIG. 1 in the case that the erroneous connection exists, and the injection signals output in correspondence thereto in time series.

However, if the lines 22 and 32 are inversely connected to the interfaces 102 and 103 for inputting the electronic control unit 101 due to the erroneous connection, a relation $t1<t2$ is obtained as shown by a waveform view in FIG. 4, the injection timings of the injectors 71 and 72 are delayed at 270 degree in the crank angle interval (CA), and an emission reduction of the engine or the like is caused. Accordingly, the electronic control unit 101 is structured such as to detect the erroneous connection as an erroneous connection detecting apparatus, by measuring the times t1 and t2 at a timing when the rotating speed fluctuation after starting the engine is small, and turn on the failure lamp 6 so as to display the erroneous connection in the case that the erroneous connection exists.

Figure 2:
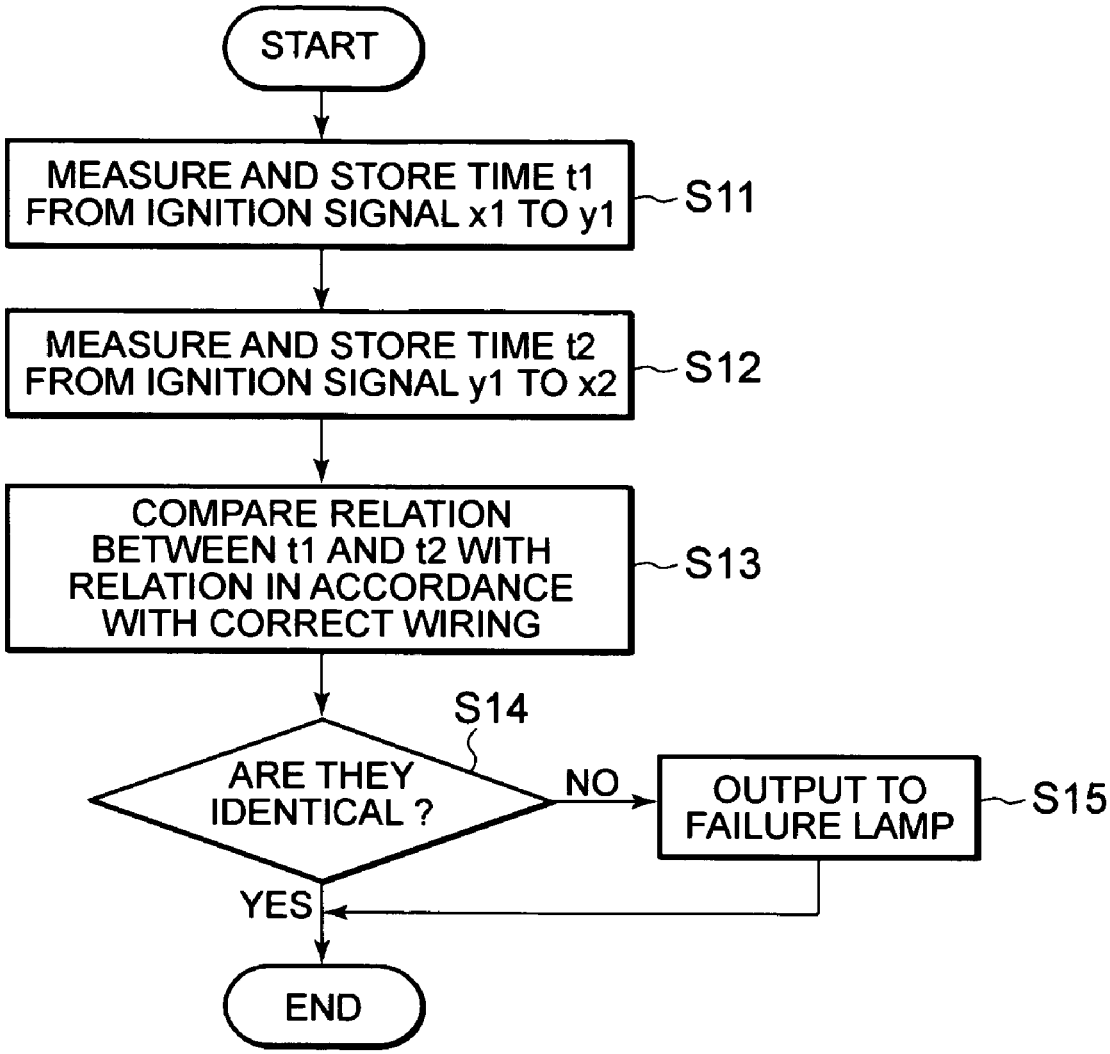
FIG. 2 is a flow chart showing a procedure of an erroneous connection detecting method by an electronic control unit in FIG. 1.

Next, the description will be given of the operation of the electronic control unit 101 in accordance with the present embodiment, that is, an execution of the erroneous connection detecting method in accordance with the present invention, while using the flowchart in FIG. 2.

If the rotating speed becomes stable after starting the engine, the electronic control unit 101 measures and stores the time t1 from the ignition signal x1 to the ignition signal y1 which is continuously input by the interval time measuring means 105 (a step 11), and measures and stores the time t2 from the ignition signal y1 to the ignition signal x2 which is successively input (a step 12).

Further, it compares a normal magnitude relation in the same engine strokes as the ignition signal intervals measured in the case of the correct line connection stored in advance in the memory means 106, with a magnitude relation between the measured times t1 and t2, in the interval time comparing means 107 (a step 13). Further, for example, in the case that the normal relation between times t1 and t2 is stored as t1>t2, the step determines whether or not the relation between the measured times t1 and t2 is identical to the relation t1>t2 (a step 14). Further, if they are identical, the step is finished, and if the relation is inverted to t1<t2 and they are not identical, the step determines that the erroneous connection is generated in the lines, and turns on the failure lamp 6 constituting the erroneous wiring display means 108 from the erroneous wiring display means 108 via the output means 109 so as to display (a step 15).

Since the electronic control unit 101 executes the erroneous connection detecting method as mentioned above, thereby functioning as the erroneous connection detecting apparatus of the wiring to the ignition device, and the erroneous connection detection can be executed in accordance with the comparatively simple process procedure as mentioned above, no excessive process load is applied to the CPU of the electronic control unit 101, no cylinder discriminating means constituted by the crank angle detecting apparatus or the like is required, and it is possible to securely detect the erroneous connection without causing any excessive cost increase so as to recognize.

In this case, in the description mentioned above, the description is given of the case that the present invention is applied to the two-cylinder general-purpose engine, however, the present invention is not limited to this, but can be applied to any structure as far as the adjacent interval times by the ignition signals successively output in the multiple cylinder engine are different. Further, as the method of detecting the erroneous connection from the continuously input ignition signals, for example, the method may be achieved by storing a value t1/t2 corresponding to a ratio between the normal times t1 and t2 as a numerical value, and comparing the numerical value with a numerical value of t1/t2 corresponding to a ratio between times t1 and t2 on the basis of the input ignition signals so as to judge whether or not they are identical. Further, even in the case that three or more interval times of the different ignition signals exist in the three or more cylinder engine, the comparison may be executed on the basis of a suitable combination for the comparison in three or more interval times.

What is claimed is:

1. A method of detecting an erroneous connection between a plurality of ignition devices and a fuel injection control apparatus, the method being executed by the fuel injection control apparatus of a type which is provided in a multiple cylinder engine having different interval times between respectively successive ignition timings for cylinders, and outputs fuel injection signals to injectors of the respective cylinders by receiving ignition signals, via respective lines, from the ignition devices outputting ignition signals to predetermined cylinders and utilizing the ignition signals as reference timings for fuel injection timings, the method comprising the steps of:

measuring a first interval time from an input of an ignition signal for a certain cylinder to an input of the next ignition signal, and a second interval time from an input of the next ignition signal to an input of a further next ignition signal;

determining whether or not an erroneous connection exists, by comparing a relation between the first interval time and the second interval time with a previously stored normal relation between the first interval time and the second interval time in the case that the lines are correctly connected in accordance with a predetermined procedure; and outputting and displaying the erroneous connection to a predetermined erroneous connection display means if it is determined that the erroneous connection exists.

2. The method of detecting an erroneous connection as claimed in claim 1, wherein the procedure of the comparison is executed by comparing magnitude relations between the first interval time and the second interval time or numerical values indicating a ratio between the first interval time and the second interval time, and the erroneous connection is determined if two magnitude relations or two numerical values do not coincide with each other.

3. A fuel injection control apparatus of a multiple cylinder engine executing the erroneous connection detecting method as claimed in claim 1, comprising a plurality of input interfaces for connecting lines from ignition devices so as to input ignition signals, a timer means, an interval time measuring means, an interval time comparing means, and output means outputting to the erroneous connection display means, wherein a normal relation of interval times in the same engine strokes as measured ignition signal intervals is stored in advance in a memory means, two interval times between the ignition signals are measured and stored by the interval time measuring means utilizing the timer means, a relation between two measured interval times and the normal relation between the interval times are compared by the interval time comparing means, and an erroneous connection is output to the erroneous connection display means by the output means in the case that the erroneous connection is determined.

4. A fuel injection control apparatus of a multiple cylinder engine executing the erroneous connection detecting method as claimed in claim 2, comprising a plurality of input interfaces for connecting lines from ignition devices so as to input ignition signals, a timer means, an interval time measuring means, an interval time comparing means, and output means outputting to the erroneous connection display means, wherein a normal relation of interval times in the same engine strokes as measured ignition signal intervals is stored in advance in a memory means, two interval times between the ignition signals are measured and stored by the interval time measuring means utilizing the timer means, a relation between two measured interval times and the normal relation between the interval times are compared by the interval time comparing means, and an erroneous connection is output to the erroneous connection display means by the output means in the case that the erroneous connection is determined.

* * * * *